US007342475B2

(12) United States Patent
Weger

(10) Patent No.: US 7,342,475 B2
(45) Date of Patent: Mar. 11, 2008

(54) COIL ARRANGEMENT AND METHOD FOR ITS MANUFACTURE

(75) Inventor: Robert Weger, Augsburg (DE)

(73) Assignee: Minebea Co., Ltd., Nagano (JP)

( * ) Notice: Subject to any disclaimer, the term of this patent is extended or adjusted under 35 U.S.C. 154(b) by 267 days.

(21) Appl. No.: 11/113,974

(22) Filed: Apr. 26, 2005

(65) Prior Publication Data

US 2005/0258926 A1 Nov. 24, 2005

(30) Foreign Application Priority Data

May 21, 2004 (DE) ..... 10 2004 025 076

(51) Int. Cl.
*H01F 5/00* (2006.01)

(52) U.S. Cl. ..... 336/200

(58) Field of Classification Search ..... 336/65, 336/83, 178, 192, 212, 200, 232
See application file for complete search history.

(56) References Cited

U.S. PATENT DOCUMENTS 1,748,993 A 3/1930 Purdy
4,953,047 A 8/1990 Toyama
5,335,163 A * 8/1994 Seiersen ..... 363/126
2005/0116801 A1* 6/2005 Proehl et al. ..... 336/200

FOREIGN PATENT DOCUMENTS

| | | |
|---|---|---|
| DE | 1 003 849 | 12/1954 |
| DE | 29 48 134 C2 | 11/1979 |
| DE | 33 46 811 C2 | 3/1983 |
| DE | 196 50 996 A1 | 11/1996 |
| DE | 19631375 | 2/1998 |
| DE | 100 51 157 A1 | 10/2000 |
| EP | 0291602 | 11/1988 |
| EP | 0989568 | 3/2000 |

OTHER PUBLICATIONS

Ishii Tetsuo, "Electromagnetic Inductive Coupling Type Connector", Application No. 60015677, filed Jan. 28, 1985, Abstract Only.

* cited by examiner

*Primary Examiner*—Tuyen T. Nguyen
(74) *Attorney, Agent, or Firm*—Duane Morris LLP

(57) ABSTRACT

A coil arrangement that has a primary and a secondary C-shaped core, each C-shaped core having an elongated base and two shorter legs at the ends of the base, a winding being applied to each base and the ends of the windings being electrically connected at the legs of the cores and the cores being arranged with respect to each other such that the legs of the two cores are located opposite each other.

10 Claims, 2 Drawing Sheets

COIL ARRANGEMENT AND METHOD FOR ITS MANUFACTURE

FIELD OF THE INVENTION

Figure 1:
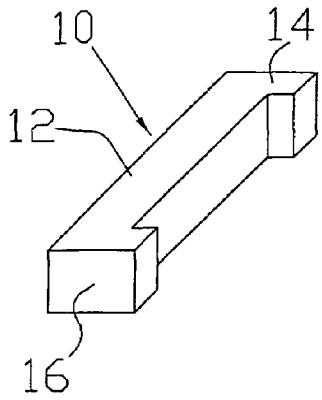
Figure 1:
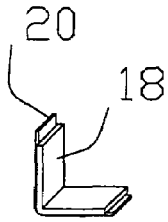

The invention relates to a coil arrangement and a method for its manufacture. The invention particularly relates to a coil arrangement that can be employed in high-frequency applications as a choke, a storage choke for example, or as a high-frequency transformer. One practical application of the coil arrangement according to the invention is its use in a switch mode power supply.

BACKGROUND OF THE INVENTION

A coil arrangement that can be employed as a power transformer in a switch mode power supply is described, for example, in U.S. Pat. No. 5,543,773. The coil arrangement revealed in this document uses a primary and a secondary winding which are mounted onto a trapezoid core and interleaved on the same winding layer. The aim of this arrangement is to minimize the leakage flux density and thus to minimize losses of the coil arrangement, and, more generally, to minimize winding conduction losses. To this effect, a relatively complex, interleaved winding procedure is provided.

Due to the rapid development in power electronics, particularly in the field of switch mode power supply technology, inductive components have gained significantly in importance. The tendency towards higher integration densities, which was extremely successful in the case of semiconductor components, is also in demand for magnetic components. A reduction in the size of magnetic components can be particularly achieved by increasing the working frequency (high-frequency coils for power applications are currently being produced in a range of between 100 kHz and a few MHz). The demand for a higher working frequency and high efficiency has produced winding structures or coil arrangements that show the least possible skin or proximity effect (please see: IEEE Proceedings ICIT03: R. Weger, "Resonant Converter with Current Controlled Inductances", 2003, Maribor, Slovenia).

Conventional magnetic components consist of a core that conducts the magnetic flux (typically a ferrite material in the case of high-frequency applications), and a core body that carries one or more windings. The general aim is to make the core small enough so that its winding window will be as full as possible. The resulting multi-layer windings, however, create considerable losses through skin effect or proximity effect.

A known approach in the design of more compact inductive components, in particular flatter and more easily fabricated components, is pursued using planar technology. Inherent to this technology, however, are winding geometries whose magnetic fields have an impact well beyond the immediate vicinity of the component. This detrimental characteristic is particularly evident in the case of magnetic components that have low relative effective magnetic permeability (e.g. storage coils) and results in undesirable induction effects on adjoining circuit components and in additional power dissipation. The object of the invention is to provide a coil arrangement which is suitable for use as a high-frequency choke, particularly as a storage choke, and also for use in high-frequency transformers as found, for example, in switch mode power supplies. The coil arrangement according to the invention is designed to eliminate the shortcomings of the prior art as described above. The object of the invention is to produce flatter, more compact and more efficient magnetic components. The coil arrangement should have good power density, high efficiency and excellent characteristics in terms of electromagnetic compatibility (EMC) and electromagnetic noise emission.

SUMMARY OF THE INVENTION

This object has been achieved by a coil arrangement and method for manufacturing the coil arrangement.

The invention provides a coil arrangement that has two C-shaped cores both of which have an elongated base and two shorter legs at the ends of the base. The length of the windable base of the core should be at least five times the diameter of the base. A winding is mounted on each base and the ends of the windings are electrically connected at the core legs. The two C-shaped cores are arranged with respect to each other such that their legs point towards each other and are located opposite each other with a defined spacing between one another. The legs are relatively short compared to the length of the bases. They project only marginally beyond the base, preferably by the diameter or twice the diameter of the winding wire. If the coil arrangement is used as a transformer, the air gap between the C-shaped cores can be reduced towards zero in that the cores are joined directly together (e.g. bonded) without the use of spacers.

The invention goes to produce a coil arrangement which is perfectly suited for use as either a choke or a transformer in high-frequency applications. For example, the coil arrangement can be used as a storage choke in a switch mode power supply. The coil arrangement according to the invention makes it possible to achieve excellent characteristics in terms of power density, efficiency and electromagnetic induction. There is the additional advantage that the coil arrangement according to the invention is very compact and flat, making the coil arrangement perfectly suited for SMD (Surface Mounted Device) technology on circuit boards.

In the preferred embodiment of the invention, the part of the ferrite core that carries the windings is either provided with an electrically insulating coating or wound with an insulating tape, making a separate coil carrier unnecessary. In special cases where the coil is only subjected to low voltages, such insulation between the core and the winding may be omitted. Since a coil body is not used and thanks to its simple construction, the coil arrangement holds out the promise of cost advantages vis-à-vis the prior art.

The windings are preferably applied in a single layer to each core and distributed evenly over the length of the base, which goes to provide the core with particularly favorable magnetic properties and to minimize losses due to skin effect und proximity effect.

The diameter of the winding wire should not exceed three times the skin penetration depth. The skin penetration depth is a function of the working frequency and the specific conductivity. For copper wire, the skin effect penetration depth δ at realistic operating temperatures (in the range of about 25° C.-65° C.) can be approximately calculated as follows:

$$\delta[\mathrm{mm}] \approx \frac{2.2}{\sqrt{f\,[\mathrm{kHz}]}}$$

Should the current load require a larger wire cross-section, two or more wires can be wound in parallel (bifilar, trifilar . . . ) or copper foil may also be used.

The legs of the C-shaped cores are preferably only slightly longer than the diameter of the winding wires applied to the bases and, in particular, only slightly longer than the diameter of a single winding layer (wire diameter). This has the advantage that the bases of the C-shaped cores can be arranged relatively close to each other allowing the space for the coil arrangement to be optimally utilized, two air gaps being formed by the short legs located opposite each other. When used as a storage choke, the design-related creation of two air gaps proves a considerable advantage since the magnetic leakage flux from two magnetic air gaps lying in series is considerably less than the leakage flux from an equivalent single air gap. In addition, the applied winding geometry assists in minimizing the external leakage field. On the one hand, poloidal coils are involved which have a coil length that is considerably greater than the coil diameter. These kinds of poloidal coils generate a smaller external leakage field from the outset. On the other hand, the two poloidal coils with opposing magnetic polarization lie spatially close together so that their far fields cancel each other out.

The legs of the C-shaped cores are (at least) slightly longer than the thickness of the windings applied to the bases. This is necessary to enable the magnetic circuit to be closed without a gap (the legs of two halves of the core located opposite each other touch each other). If a gap is to be provided, it is advisable to make the legs about an air-gap width longer than the diameter of the windings in order to keep the strong magnetic field near the gap away from the edge turns of the winding.

Should the application require a particularly large air-gap volume, the two partial gaps can be doubled in number to four partial gaps by introducing short I-cores. The length of the I-core should be kept as small as possible but should be considerably larger than the distance of the resulting gap, at least, however, three times the gap distance. As a result of this design, two identical air gaps are created between the opposing legs of the two halves of the core. With the use of spacers, the air gaps can be set at any desired distance from each other before the core halves are secured. The spacers can either be bonded permanently between the halves of the core or only wedged temporarily between these core halves. In the latter instance, it is advisable to additionally secure the core halves using epoxy resin once the spacers have been removed. The halves of the core can be pressed together before soldering using, for example, a mechanical bracket.

Each leg has at least one electrically conductive surface to connect the windings. In one embodiment of the invention, the legs have a rectangular cross-section. In this embodiment, two leg surfaces that adjoin each other are preferably provided with an electrically conductive contact foil in order to connect the windings. Although the bases may have round cross-sections, the legs are preferably rectangular for connection purposes. Insulation is provided between each leg surface and the electrically conductive foil. The contact surfaces on the core halves can be soldered directly to the tracks on a circuit board.

If a core half carries more than one winding, such as in the case of a bifilar winding, the contact surfaces may also be segmented allowing the winding ends to be connected separately.

The C-shaped cores are preferably designed and constructed in such a way that the legs extend essentially perpendicular to the bases at their outer ends.

The coil arrangement according to the invention can provide the following advantages:

The coils can be fabricated with a very flat and compact geometry promoting an excellent utilization of space. In practice, the coil arrangements are suitable for use as both storage chokes (series inductors) as well as transformers. Due to its design and construction according to the invention, the coil arrangement can not only be suitably realized as a miniaturized SMD choke coil or inductor but also as a power inductor in the kW range.

The single-layer coil geometry minimizes skin effect-related losses in the winding. The elongated, flat C-shape goes to minimize the proportion of magnetic dead volume in the legs thus reducing core losses. The physical division of the air gap into two partial gaps reduces the external eddy currents in the vicinity of the gap. The partial gaps are additionally localized outside the windings so that losses in the winding caused by leakage field induction remain minimal. The geometry of the coil arrangement and the division of the air gap into two partial gaps guarantees minimized magnetic stray fields and thus excellent electromagnetic compatibility.

Any electromagnetic emission can be further reduced in that the double gap between the two legs is increased to a fourfold gap, for example, by inserting short I-cores between the legs of the two C-cores of the coil arrangement, as described above.

Moreover, in the coil arrangement according to the invention, the length of the base of the core is large in comparison to its diameter, resulting in a rapid reduction in external leakage fields.

Finally, a further advantage can be found in the extremely simple, compact, material-saving construction of the coil arrangement, its easy handling and the resulting low costs. The space taken up by the coil arrangement is optimally utilized. No space is required for a coil body.

The region of the core at the legs that is not needed for the winding is used for connection purposes. The coil arrangement makes it possible to realize extremely flat magnetic components.

The invention thus creates a magnetic component that, due to its special geometry, shows improved characteristics in terms of energy efficiency, energy density and EMC than components according to the prior art. This has been achieved by the elongated and to date very unusual shape of the core. In the preferred embodiment, the length of the core base that can be wound should be at least five times the base diameter. The legs should project only slightly beyond the base, by only one or two wire diameters. The winding is single layered and the diameter of the wire is smaller than three times the skin penetration depth.

The invention also provides a method for manufacturing such a coil arrangement in which a winding is mounted on each base, the ends of the windings are electrically connected at the core legs and the cores are arranged side by side such that the legs of the two cores are located opposite each other with a spacing between them.

The spacing between the cores is preferably created using a spacer that is inserted between the two cores before the legs of the cores are secured on a carrier. Once the legs have been secured, the spacer can be removed. The legs of the cores are preferably soldered onto a circuit board.

Particularly in the case of large coil arrangements and small spacings between the cores, it is advantageous if the legs of two cores located opposite each other are additionally secured, for example, by adding a drop of epoxy resin.

SHORT DESCRIPTION OF DRAWINGS

Figure 2:
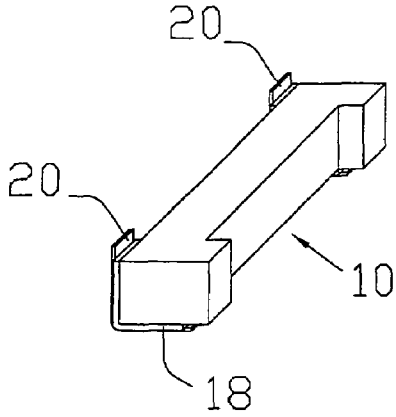
Figure 2:
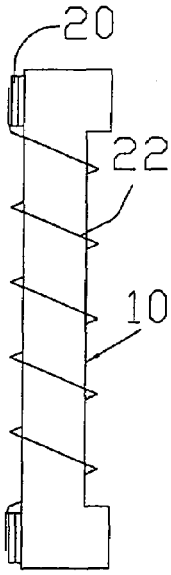
Figure 3:
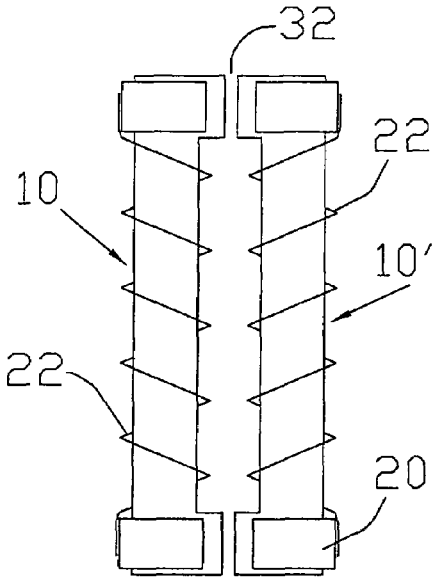
Figure 4:
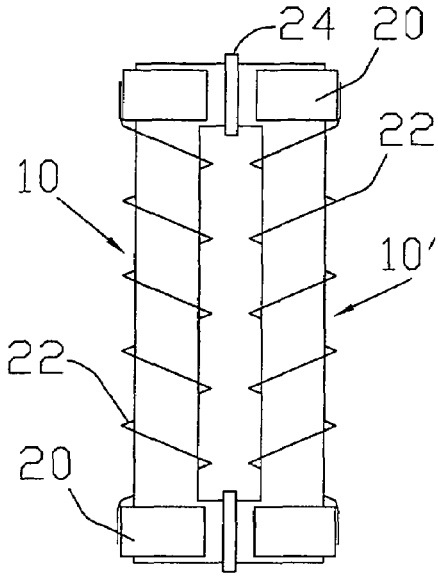
Figure 5:
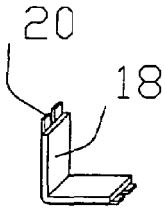
Figure 6:
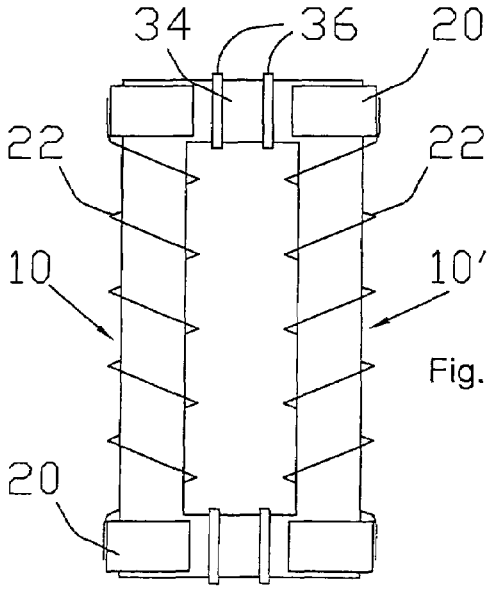
Figure 7:
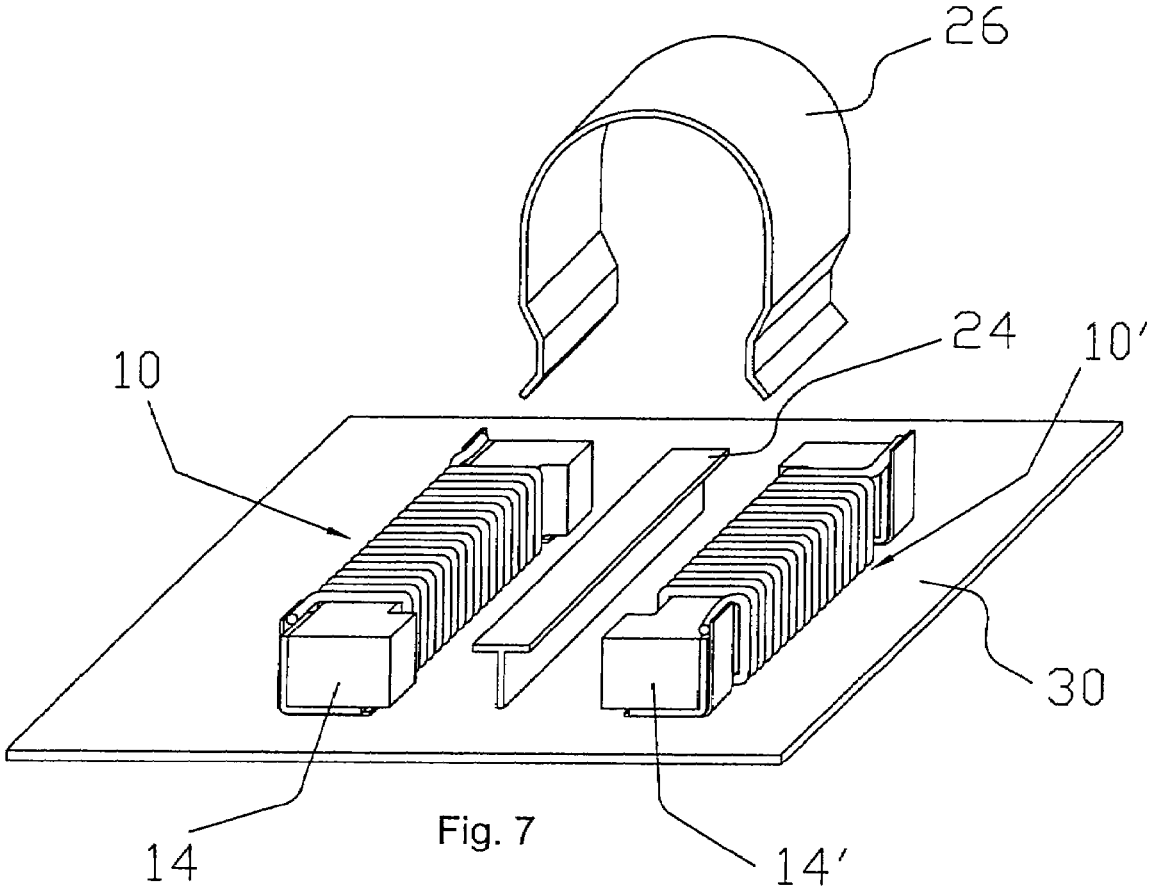

The invention is explained in more detail below on the basis of preferred embodiments with reference to the drawings. The figures show:

FIG. 1 a perspective view of a C-core for the manufacture of a coil arrangement according to the invention;

FIG. 2 a view from above of a C-core on which a winding has been mounted;

FIG. 3 a bottom view of two wound C-cores located opposite each other for the construction of a coil arrangement according to the invention;

FIG. 4 a similar view from below as in FIG. 3, spacers being inserted between the C-cores;

FIG. 5 a perspective view of a connecting body for the coil arrangement according to the invention;

FIG. 6 a similar view as in FIG. 3, spacers and I-cores being inserted between the C-cores; and FIG. 7 a perspective exploded view of two C-cores located opposite each other that are separated by a spacer and held together by a clamping bracket for the construction of a coil arrangement according to the invention.

DETAILED DESCRIPTION

The coil arrangement according to the invention is based on the use of two identical C-shaped cores, or C-cores, each forming one half of the coil. The C-cores are preferably made from a ferrite material. FIG. 1 shows a perspective view of a C-core 10 which has an elongated base 12 and two comparatively short legs 14, 16 protruding from the ends of the base and perpendicular to the base. The C-core of the coil arrangement according to the invention is preferably designed with relatively short legs 14, 16 that project from the base 12 by slightly more than a winding diameter. The C-core 10 thus degenerates towards an I-core. The illustrated C-core 10 structure means that only minimum space is required for the construction of the coil arrangement according to the invention.

The base 12 is preferably coated with an insulating material, e.g. with an insulating plastic tape or a coat of epoxy. This makes it possible to mount a winding directly onto the core 10 without the need for additional insulation or coil carriers. In the illustrated embodiment, the core 10 has a rectangular cross-section. The edges of the core 10 are preferably smoothed or rounded to avoid any injury or damage to the material.

Alongside the C-core 10, insulating spacers 18 as well as electrically conductive contact foils 20 are shown in FIG. 1. The contact foils 20 could be cut from copper foil, for example. The electrically conductive contact foils act as contact surfaces and are attached (e.g. bonded) to the legs 14, 16 of the C-core 10, as illustrated in FIG. 2. The electrically conductive contact foils 20 are preferably seated on insulators 18 that are slightly thicker than the diameter of a winding. In the illustrated embodiment, the contact foils 20 cover at least two adjoining surfaces of the legs 14 or 16 extending perpendicular to each other. They are used to connect the ends of the windings, as illustrated in FIG. 2, as well as to secure the coil arrangement onto a carrier, as explained with reference to FIG. 7. Together with the spacers 18, the contact foils 20 can be bonded to the C-cores 10. Should a C-core carry more than one winding, e.g. in the case of a bifilar winding or a trifilar winding, the foils 20 may also be segmented allowing the winding ends to be connected separately, as can be seen in FIG. 5.

As shown in FIG. 2, the base 12 of the C-core 10 carries one or more windings, a single-layer winding 22 being preferably provided. The wire of the winding 22 is distributed evenly over the length of the base 12 of the C-core 10. The ends of the winding wire 22 are connected to the electrically conductive foils 20 on the legs 14 or 16 of the core, by soldering for example.

Coil arrangements for low-frequency applications of less than approximately 100 kHz could also have a secondary winding layer. As mentioned above, it is also possible to provide bifilar or other multifilar windings.

FIG. 3 shows two wound C-cores 10, 10' that, in order to create the coil arrangement according to the invention, are arranged with respect to each other in such a way that their legs 14, 16 point towards each other and are located opposite each other with a spacing between them. The spacing determines the width of the air gap 32. The two wound C-cores could be used to form a magnetic element such as a choke or a transformer (without air gap).

FIG. 4 shows a similar view as in FIG. 3, a spacer 24 being inserted in the gap 32. Using the spacers, the air gaps 32 can be adjusted to any required distance before the C-core is secured. The spacers 24 may either be permanently bonded between the C-cores or only temporarily wedged between the C-cores. FIG. 6 shows a similar view as in FIGS. 3 and 4, a wound I-core 34 being inserted between each of the wound C-cores 10, 10', the I-core 34 being separated from the C-cores 10, 10' by spacers 36. The inclusion of I-cores 34 makes it possible to double the two partial gaps between the C-cores 10, 10' to four partial gaps. The length of the I-cores 34 should be as short as possible, but on the other hand distinctly larger than the distance of the resulting gap and preferably at least three times the gap distance.

FIG. 7 is a perspective view of a primary and a secondary wound C-core 10, 10' that is mounted onto a circuit board 30. In FIG. 7, a spacer 24 and a bracket 26 are shown which are used to set the C-cores 10, 10' in the correct position with respect to each other and to hold them in this position.

The spacers 24 are inserted between the two C-cores 10, 10' in order to adjust the spacing between the respective legs 14, 16, 14', 16'. The arrangement thus assembled is held firmly together by the bracket 26. The entire arrangement is placed on contact fields (not illustrated) on the circuit board 30, and the legs 14, 16, 14', 16' of the C-cores 10, 10' coated with copper foil or a similar coating are soldered onto the contact fields. The bracket 26 and the spacers 24 can then be removed and reused in the manufacture of other coil arrangements.

If the C-cores 10, 10' are comparatively large and the gap between them is small, it could be advantageous to add a fixing agent, for example a drop of epoxy adhesive, to each gap 32 to additionally secure the length of the gap.

A method for manufacturing the coil arrangement according to the invention is described below, whereby the technician will realize that the invention is not limited to the specific information provided here. In order to insulate the winding space, the C-cores 10, 10' are coated with epoxy resin, for example, by means of dipping. It is of course understood that other insulating materials could also be used and it is also possible for the bases 12 of the C-cores to be wound with a tape made of an insulating material. Here, the end faces of the legs 14 should remain uncoated. The insulators 18 and the contact foils 20 are then bonded to the legs 14 (see FIG. 1). The winding is applied to the base 12. The winding ends are soldered to the contact foils 20 (see FIG. 2). The wound and connected C-cores 10, 10' are arranged on a level plate mirror symmetric to each other and pressed together using the bracket 26 (see FIG. 7). If air gaps are required in the flux line channel of the C-cores 10, 10', a suitable spacer 24, as shown in FIG. 7, is placed between the end faces of the legs 14. The coil arrangement held mechanically together by the bracket 26 can now be placed directly onto a circuit board 30 and soldered to the tracks.

After soldering, the bracket 26 and the spacer 24 are removed and the gap 32 can be filled or secured with epoxy resin.

In another embodiment of the invention, it can be provided that the cores 10, 10' are designed as SMD components. In practice, these SMD cores are set on an SMD board by pick and place machines and soldered in a reflow soldering process. This technique makes it possible to position the cores with a defined spacing between them and to solder them onto the board without the need for brackets and spacers.

The characteristics revealed in the above description, the claims and the figures can be important for the realization of the invention in its various embodiments both individually and in any combination whatsoever.

IDENTIFICATION REFERENCE LIST

10, 10' C-cores
12 Base
14, 16, 14', 16' Legs
18 Insulators
20 Contact foil
22 Winding
24 Spacer
26 Bracket
28 Contact field
30 Circuit board
32 Gap
34 I-core
36 Spacer

The invention claimed is:

1. A coil arrangement having a primary and a secondary C-shaped core (10, 10'), each C-shaped core (10, 10') having an elongated base (12) and two shorter legs (14, 16, 14', 16') at the ends of the base, a winding (22) being applied to each base (12) and the ends of the windings (22) being electrically connected at the legs (14, 16, 14', 16') of the cores and the cores (10, 10') being arranged with respect to each other such that the legs (14, 16, 14', 16') of the two cores (10, 10') are located opposite each others, wherein contact areas are provided on at least one surface of each leg of the C-shaped core, said surface being located on a face of the leg different than the end face, and wherein a winding is provided on each base, the winding ends being in electric contact with the contact areas.

2. A coil arrangement according to claim 1, wherein a gap (32) is formed between the legs of the two cores.

3. A coil arrangement according to claim 1, wherein the bases (12) of the cores (10, 10') are coated with an insulating material.

4. A coil arrangement according to claim 1, wherein the windings (22) are applied in a single layer.

5. A coil arrangement according to claim 4, wherein the legs (14, 16, 14', 16') protrude from the base by a distance which is slightly longer than the diameter of the windings (22) applied to the bases (12).

6. A coil arrangement according to claim 1, wherein each leg (14, 16, 14', 16') has at least one electrically conductive surface to connect the windings (22).

7. A coil arrangement according to claim 6, wherein an electrically conductive contact foil (20) is mounted on at least one surface of each leg (14, 16, 14', 16'), an insulator (18) being provided between the leg surface and the foil (20).

8. A coil arrangement according to claim 1, wherein the cores (10, 10') have an essentially rectangular cross-section.

9. A coil arrangement according to claim 1, wherein the bases of the cores have a round cross-section and the legs have a rectangular cross-section.

10. A coil arrangement according to claim 1, wherein the legs (14, 16, 14', 16') extend essentially perpendicular to the bases (12).

* * * * *